US005890944A

United States Patent [19]

Wiggs et al.

[11] Patent Number: 5,890,944

[45] Date of Patent: Apr. 6, 1999

[54] TOY WITH MOVING ARTICLE

[75] Inventors: Christopher Charles Wiggs; Christopher Joseph Crabtree Taylor, both of London, England

[73] Assignee: Origin Products Ltd., London, England

[21] Appl. No.: 899,178

[22] Filed: Jul. 23, 1997

[30] Foreign Application Priority Data

| | | | |
|---|---|---|---|
| Jul. 24, 1996 | [GB] | United Kingdom | 9615584 |
| Sep. 26, 1996 | [GB] | United Kingdom | 9620059 |

[51] Int. Cl.[6] ..... A63H 33/26; A63H 13/00

[52] U.S. Cl. ..... 446/135; 446/358

[58] Field of Search ..... 446/129, 130, 446/131, 132, 133, 134, 135, 136, 137, 138, 139, 352, 357, 358, 359, 444, 446

[56] References Cited

U.S. PATENT DOCUMENTS

| | | | |
|---|---|---|---|
| 1,323,232 | 11/1919 | Page | 446/135 |
| 2,036,076 | 3/1936 | Philippi | 446/135 |
| 3,143,826 | 8/1964 | Ellis | 446/136 |
| 3,426,476 | 2/1969 | Ayala | 446/134 |
| 3,481,071 | 12/1969 | Hinkson | 446/135 |
| 3,626,516 | 12/1971 | Handweiler | 446/135 X |
| 3,785,648 | 1/1974 | Kobayashi . | |
| 3,946,520 | 3/1976 | Goldfarb et al. | 446/135 |
| 4,012,040 | 3/1977 | Fernandes . | |
| 4,834,371 | 5/1989 | Hay et al. . | |
| 5,417,605 | 5/1995 | Chan . | |

FOREIGN PATENT DOCUMENTS

| | | | |
|---|---|---|---|
| 1072548 | 9/1954 | France | 446/135 |
| 1112934 | 11/1955 | France | 446/135 |
| 1111975 | 3/1956 | France | 446/135 |
| 873003 | 4/1953 | Germany | 446/135 |

*Primary Examiner*—D Neal Muir

*Attorney, Agent, or Firm*—Woodard, Emhardt, Naughton, Moriarty & McNett

[57] ABSTRACT

The toy and movable article which are the subject of this application provide for the article to be moved along a playbase by mechanical assembly and/or variable magnetic field which are remote from and not in physical contact with the article thereby giving the article the effect of being independently movable. The exertion of the movement is via a magnetic arrangement between the mechanical assembly and/or variable magnetic field and article and which, if the article is a scale model of a human character can be arranged in conjunction with the shape of the article, to impart a walking effect on the article as it moves thereby adding to the realism of the toy and article.

19 Claims, 8 Drawing Sheets

260
270
250
231
230
4
240
241
210
220

TOY WITH MOVING ARTICLE

FIELD OF THE INVENTION

The invention which is the subject of this application relates to apparatus for a toy which allows an article such as, but not exclusively, a model of a person, an animal or the like, to be moved around a play base and environment created thereon without any direct physical force being applied thereto.

BACKGROUND OF THE INVENTION

Conventionally it is known for toys to be movable and it is easily understood that movement of toys renders the same significantly more attractive to children. This attractiveness is further enhanced if the movement of the article, such as a model of a human character, is not directly controlled in that the child does not have to physically touch the model. For this reason puppets which are controlled by strings are attractive to children and also give the child a degree of fascination and the models a life like quality. The problem with puppets however is that the control strings can become tangled or break and furthermore the ability to incorporate the same into particular environments or to produce the same on a small scale is limited due to the requirement to have no barriers over the puppet so that the strings can be freely moved and if the model is too small the complexity of the controls is too great.

A further method for providing movement is to provide the model to be movable along a base having a predefined track such that the model can be slid along the track to move in a predefined and selected direction or path. The main disadvantage with this arrangement is that the model can only ever move in a predefined path and therefore the toy soon loses its appeal to children as their interest level wanes. Also known is the ability to provide a model with a magnet and to provide a control means with a magnet and to use the magnetic field to cause movement of the model by movement of one or both of the magnets. However, the movement in these conventional toys is only movement of the model while the model remains at the same point on the toy base.

SUMMARY OF THE INVENTION

The aim of the present invention is to provide a toy which includes an article which is movable around an environment created on a base along which the article moves in a selected but not predetermined path without the need for physical contact with the article by the child. A further aim is to provide a control means for the movement of the article which is arranged to be controlled for movement from a point remote to the article and also to provide the control means with mechanical advantage thereby increasing the scope of movement of the article.

In a first aspect of the invention there is provided apparatus for a toy, said apparatus comprising a play base of substantially planar material having a first, upper side along which an article is provided for movement and on the second, under, side, control means for movement of the article and wherein the article includes mounted therein at least a first magnet and the control means includes at least a second magnet and said first or second magnet is arranged to be movable relative to the other magnet to cause the article to move along the base in a selected direction by selected movement of the control means.

Typically the relative movement of the magnets is arranged such that the condition of the magnetic field between said magnets changes during movement and thus creates movement of the article in addition to the movement of the article along the base.

It should be noted that it may be possible that one of the first or second magnets is replaced by a magnetically attracted material and reference hereonin to magnets includes this arrangement.

In one embodiment the condition of the magnetic field is altered by the movement of the magnet such that the first or second magnet is moved to position the same to have a peak polar strength at one instant when the particular magnet pole is positioned close to the underside of the play base and a minimum polar strength when the particular magnet pole is positioned at the furthest possible point away from the other magnet. Movement between the peak and minimum positions is preferably of substantially constant speed and the variation between peak and minimum conditions is sufficient to cause a visual effect on the movement of the article but is always sufficiently strong to allow the article to be magnetically attracted to stay on the surface of the base so that it continues to be moved along the base. By rotating the magnet said peak and minimum conditions are repeated for each polarity of the magnet in turn and in one embodiment the magnet is arranged such that there is never a sole north or south polarity acting on the other magnet. Thus the extent of the effect on the article can be controlled by controlling the extent of change between north and south polarity of the magnet as it rotates and this can be achieved by determining the angle of the magnet relative to the axis of rotation.

The movable magnet may also, or alternatively, be provide to rotate relative to the other magnet such that the polarity of the moving magnet changes more quickly and to a greater extent between poles relative to the other magnet thereby creating a greater visual effect on the movement of the article.

In certain arrangements it is possible that both the first and second magnets can be arranged to rotate.

In whichever arrangement it is envisaged that the magnet which is movable is preferably mounted on the control means and is provided to rotate as the control means moves along or adjacent to the underside of the base and as it does so causes the at least first magnet and hence the article to which it is attached to move along the upper surface of the play base.

In one embodiment the control means comprises a roller upon which a disc magnet is mounted at an angle to the axis of rotation of the roller which is in itself substantially parallel with the base. Thus as the roller rotates so the position of the poles of the disc magnet to the base and hence the article on the other side of the base alters and so the condition of the magnetic field alters on an alternating basis.

The roller on which the magnet is mounted is driven via a gear arrangement by movement of the control means along the underside of the play base and typically a second roller with a sleeve which contacts the play base is provided and the roller is connected to the magnet roller to turn the same and said magnet and second rollers are mounted in a common bracket. Preferably a resilient member acts on the bracket to bias the sleeve on the roller into contact with the base underside and said resilient member, magnet and second rollers are mounted in a housing which in turn is connected via an arm to a lever and disc drive arrangement, typically a pantograph arrangement, which allows control of the movement of the magnet relative to the base, from a common single position. Typically the control means is provided in a form which provides mechanical advantage to the article movement.

Typically the toy is provided with a cover which encloses the control means between said cover and the underside of the play base. Typically the cover also includes raised protrusions which act as guide means for the area of movement of the housing and in particular a pin protruding below the housing. Typically said protrusions are linked to the position of objects on the upper side of the base and in relation to which the article is movable. By providing the pin to contact the protrusions rather than the housing so the position of the article on the play base can be more accurately determined and more finely controlled. This is especially important where the article is required to pass along relatively narrow spaces and said control is further improved by providing the pin directly below the position of the magnet of the control means.

Alternatively the magnet on the control means can be arranged with an axis of rotation such that the polarity of the magnet acting on the magnet or magnets in the article alternates between substantially wholly North and South poles as the magnet rotates.

In a further aspect of the invention there is provided an article for a toy, said article arranged for movement along a base and wherein said article is provided with at least one magnet mounted thereon and is movable along said play base by control means arranged to operate under the play base and physically separate from the article by said base, said control means including at least a second magnet and movement of the control means causes the article to move under the influence of the magnetic field created between the article and control means.

In one arrangement the article is a human character or an animal and the at least first magnet is mounted in the area of the article depicting the feet of the same.

In one preferred embodiment the article is provided with two, separate, legs and at the base of each leg there is provided a magnet. Typically the magnets are arranged so that one of the magnets has a north polarity adjacent the base and the other has a south polarity adjacent the base. Typically the legs are rigidly interconnected with the ends of the same, in one embodiment, lying in the same plane or alternatively, arranged such that when one of the legs is in contact with the base the end of the other leg lies out of contact and at an angle to the base so that when the article moves alternate leg ends contact the base and thereby mimic a walking effect. By providing the magnets with opposite polarities so the walking effect is increased as, as one magnet is attracted to the magnet of the control means at any one instant so the other magnet is being repelled at that instant. The extent of attraction and repulsion is dependent upon the relative position of the control means at that instant.

In one arrangement the body and/or head portions of the article are pivotally mounted on the legs portion of the article such that as the legs move so the body and/or head portion can rotate freely or at least between designated end positions thereby enhancing the walking effect when the same moves.

Typically the article is a model and may be as small as 10–20 mm in height and preferably the play base is provided on its upper side with a model environment into and through which the article can be moved by the control means as described previously. It is also possible that the control means can be used to manipulate and move items in the environment and this is described in the applicant's co-pending application.

In a further aspect of the invention there is provided a toy including an article provided with a base portion to be movable along a playbase and a control means including a housing with, mounted therein, at least one magnet with one designated pole facing towards the underside of said playbase and said article including first and second magnets mounted in or adjacent to the base portion of the same each arranged with the opposing pole to that of the first designated pole lying closest to the playbase in use.

Typically the magnet in the housing is mounted to be movable between a first position in contact with the underside of the playbase and a second position withdrawn from contact with the underside. The magnet is arranged to be drawn to the first position by attraction of the magnet to the magnets on the article on the top side of the playbase thereby allowing the movement assembly to influence the movement of the article thereafter and withdrawn from contact with the underside due to lack of attraction.

Preferably the article includes a third magnet arranged to the rear of and preferably intermediate the first and second magnets relative to the direction of movement of the article and is of reverse polarity to the first and second magnets.

Preferably the underside of the base portion is angled and in one embodiment portions of said base portion are arranged to lie at substantially equal but opposing angles relative to the playbase. The first and second magnets can be arranged to lie at equal but opposing angles relative to the playbase and especially if they form the underside of the base portion which contacts with the playbase. The provision of the base in the angled configuration causes movement of the object parts from and to the playbase as the article moves therealong thereby mimicking a walking effect.

In a further aspect of the invention there is provided an article for use to be moved along a playbase of a toy and wherein said article comprises at least two parts, a base portion on which is mounted an upper part and said upper part is pivotally mounted on said base part to allow relative pivotal movement between said parts and thereby provide axial articulation of the same.

In one embodiment the base portion is provided with a relatively narrow upstanding portion and onto the top face of which a face of an interior port of the upper part sits to be pivotally movable in relation thereto. In one preferred embodiment stops are provided to prevent 360 degree rotation of the parts and also to impart a reverse rotational action on the upper part relative to the base part when the stops are contacted.

In one typical embodiment the base portion comprises the viewable feet and legs of the article which depicts a figure of a person and the upper part defines the arms, head and chest of the figure.

This aspect allows the article to be animated when the same is moved along the play surface. Additionally the relative movement of the parts allows the movement of the article to be more realistic than if the article was one solid part as in this form the movement of the article tends to be relatively unrealistic and does not give the effect of, for example, a normal walking action.

A further advantage is that the provision of the movable parts adds significantly to the stability of the article as it moves and is especially advantageous when the article depicts a figure as this has a relatively small base area and a relatively large height. The pivotal movement tends to disengage the effects of the upper part from acting on the base as the article moves and the jerking movement of the base as it moves is converted into pivotal movement of the parts rather than causing the article to topple over as may be the case if the article was provided as one part.

It is envisaged that the assembly herein described can be used with apparatus described in the co-pending application number GB9615506.4.

Thus the present invention provides in the various aspects described an article which is movable on a base to and between various positions on the base without the need for physical moving forces to be applied to the article and furthermore without the need for any form of control means to be physically connected thereto. Thus, the scope of possible movement of the article is greatly increased and the visual appearance of the same is such that it appears, especially to a child, that the article is moving of its own accord and, importantly, in a random manner throughout the environment on the base.

Furthermore the arrangement of the control means allows the visual effect of the movement of the article to be that it is walking rather than simply sliding along the base surface.

Thus, the toy and movable article which are the subject of this application provide for the article to be moved along a play base by control means which are remote from and not in physical contact with the article thereby giving the article the effect of being independently movable. The exertion of the movement is via a magnetic arrangement between the control means and article and which, if the article is a scale model of a human character can be arranged in conjunction with the shape of the article, to impart a walking effect on the article as it moves thereby adding to the realism of the toy and article.

BRIEF DESCRIPTION OF THE DRAWINGS

Specific embodiments of the invention will now be described with reference to the accompanying drawings; wherein.

DETAILED DESCRIPTION OF THE PREFERRED EMBODIMENT

Figure 1A:
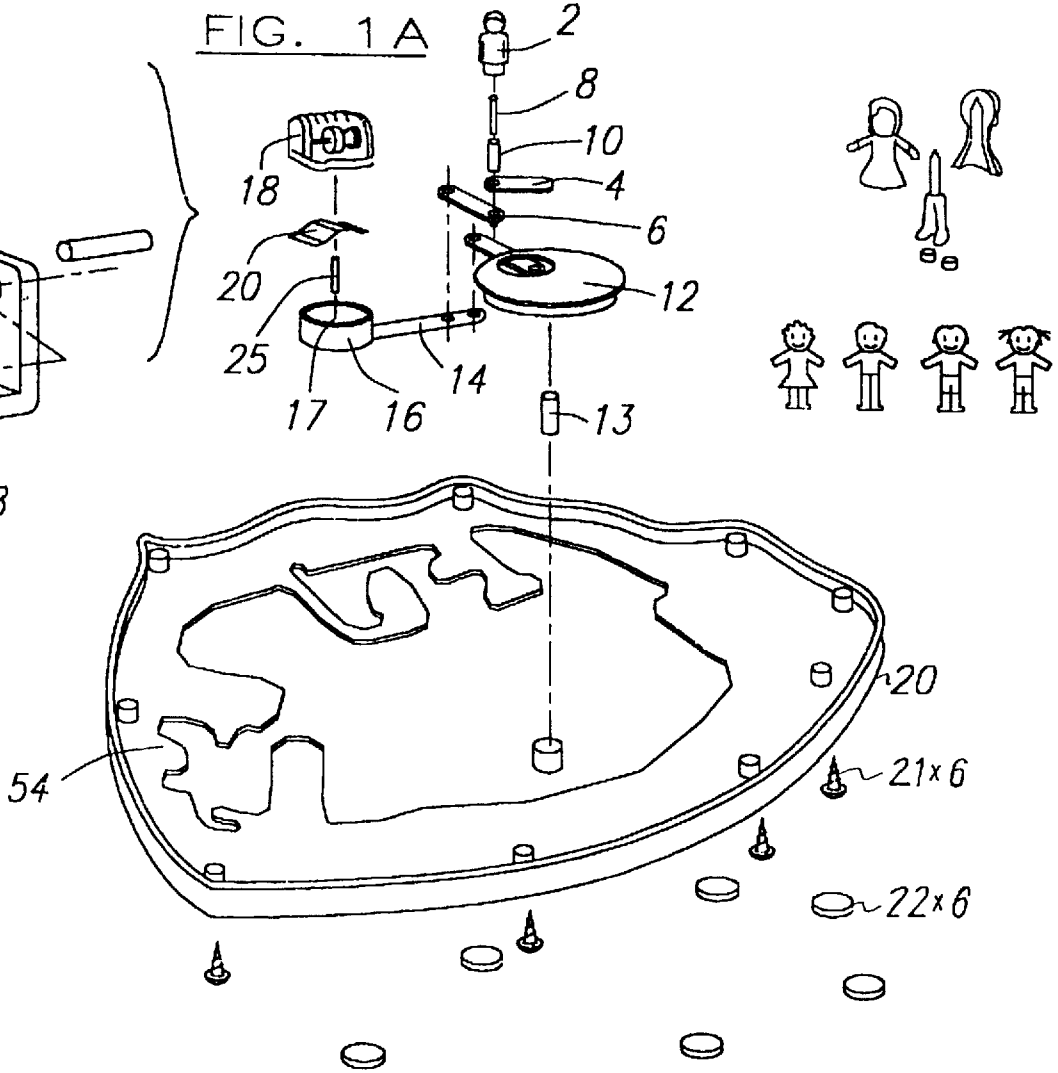
FIG. 1A–1C illustrate an embodiment of the control means in one arrangement.
Figure 1B:
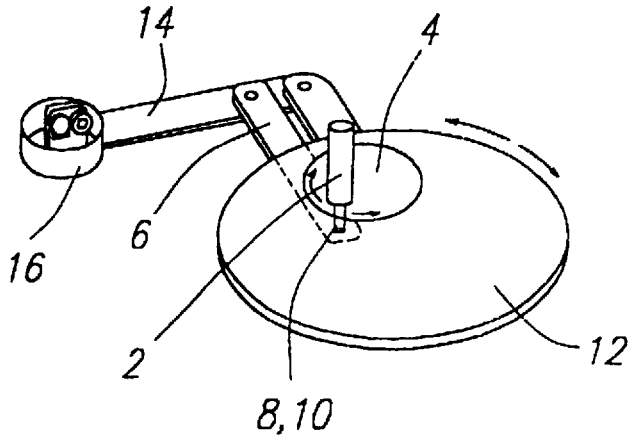
Figure 1C:
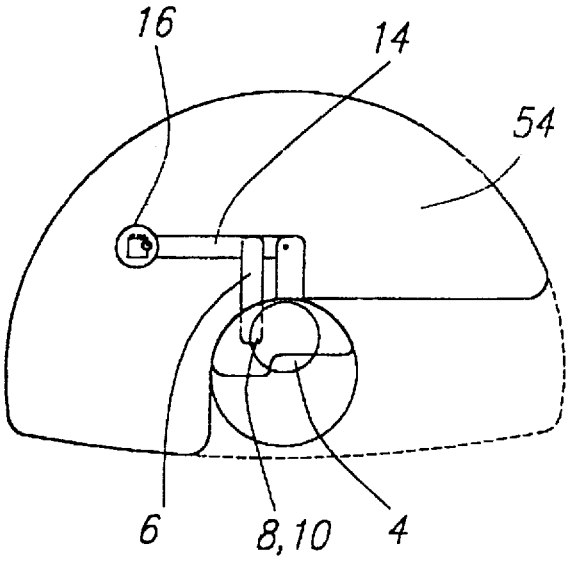
Figure 3D:
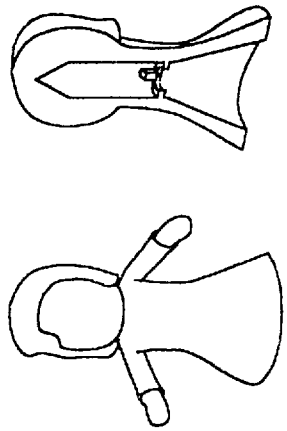
FIG. 3A–3D illustrate an embodiment of an article according to the invention.
Figure 3D:
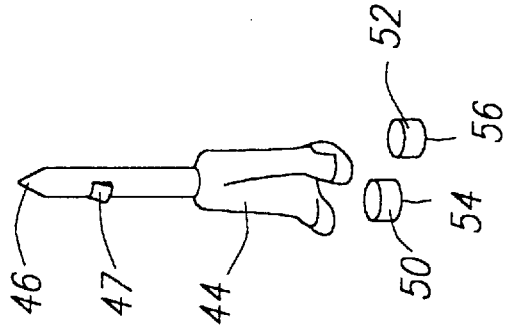
Figure 3C:
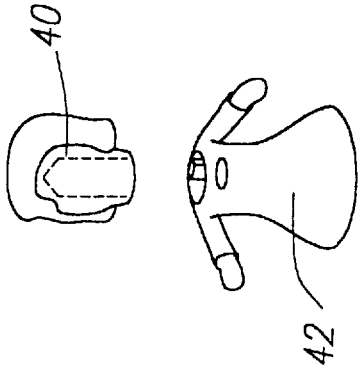
Figure 3C:
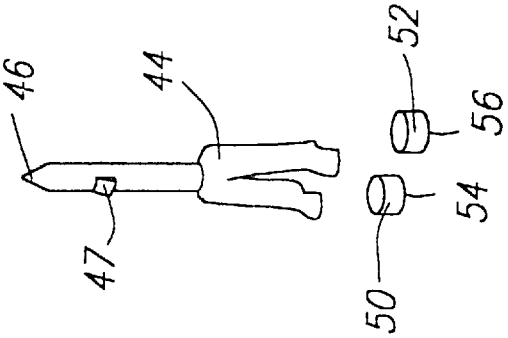
Figure 3B:
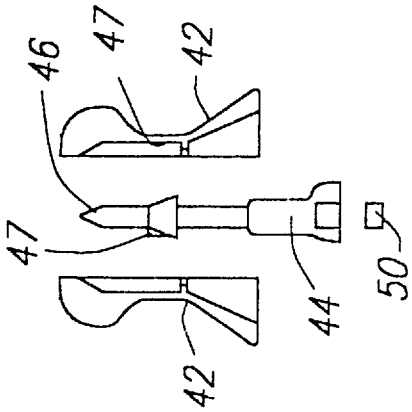
Figure 3A:
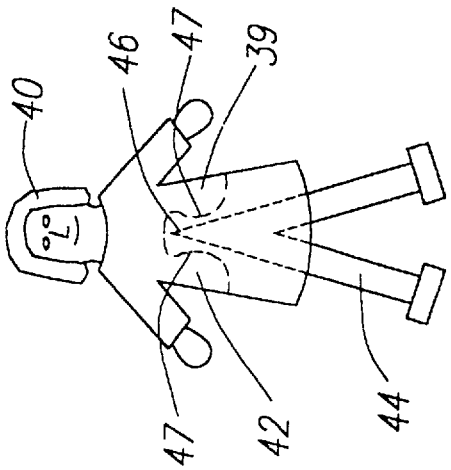

Referring firstly to FIG. 1 there is illustrated the components of a control means according to the invention, said control means comprising an actuation rod 2 which is viewable in the complete toy and may therefore be of any required shape to fit in with the environment created on the play base of the toy and movement of the same causes a 4 multiplication of the movement of the control means magnet around the base 54. The rod is in turn connected through a cover disc 4 to lever arm 6 via pins 8, 10 and said cover disc is mounted in a mover disc 12 which in turn controls the extent of movement of the actuating rod relative to the same and acts in conjunction with lever arm 6 to control the movement of a control rod 14 along the underside of the play base with which the control rod is held in close proximity and substantially parallel therewith.

At the free end of the control rod 14 is formed a housing 16 and in said housing is provided a bracket 18 and a resilient means in the form of a spring plate 20 which acts to bias the bracket toward the base underside. The bracket includes a first roller with a magnet mounted thereon and second roller with a sleeve thereon and these, and their relationship, are described with reference to FIG. 2. The bracket 18 is however pivotally movable within the housing and the pivot point 17 is provided to be located directly under the roller on which the magnet is mounted thereby allowing the position of the article on the upper side of the base to be accurately determined and preventing the movement of the article in an arc which is the case if the pivot point is offset relative to the magnet.

The housing 16 also includes a pin which prevents the article on the upper surface of the play base from coming into contact with objects on that side as there is provided a cover which encloses the underside of the play base with the control means therebetween and the cover is provided with protrusions which are described hereafter with which the pin contacts and stops before the article reaches the corresponding objects on that side of the base and this is another advantage of having the pin which also acts as the pivot point of the bracket below the magnet 26 so that the position of the article can be accurately determined to be within the confines of the housing 16.

Figure 2:
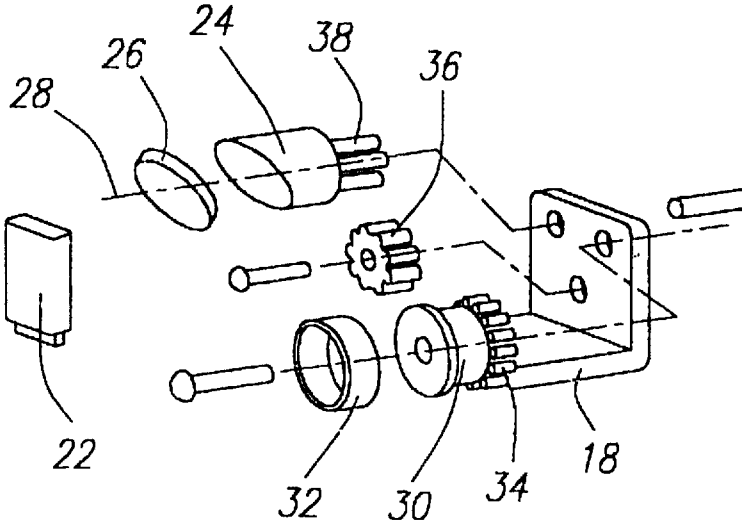
FIG. 2 illustrates a detailed view of the roller arrangement of the control means of FIG. 1.

Turning now to FIG. 2 the bracket 18 and associated parts are illustrated in greater detail. The bracket 18 includes an end stop 22 and between said end stop and bracket are mounted a roller 24 with a magnet 26 mounted in a swash relationship at an angle relative to the axis of rotation 28 and a second roller 30 which is provided with a sleeve 32 on the outer surface thereof. The roller 24 and second roller 30 are drivingly connected via gears 34, 36, 38 such that the second roller drives the roller 24 and there is a ratio of 2.5 between the same. The second roller 30 is arranged to contact with the underside of the base via the sleeve which can be of a suitable gripping material such as rubber so that when the control means is moved so the movement of the roller 30 along the underside of the base causes the roller 24 and hence magnet to be rotated. The housing also includes pin 25 which protrudes below the housing which has a chamfered underside to allow the same to ride over protrusions on the cover with which the pin contacts, if sufficient force is applied.

Turning now to FIGS. 3A–3D and 4A there are shown views of an article 39 according to one embodiment of the invention. In this embodiment the article comprises a head portion 40 which is in engagement with a body portion 42 and said portions are mounted on a legs portion 44. The portions 40, 42 are pivotally mounted on a pivot 46 which is part of the legs portion and are provided with stops 47, indicated in broken lines which allow rotation of the portions through 280 degrees.

Figure 4A:
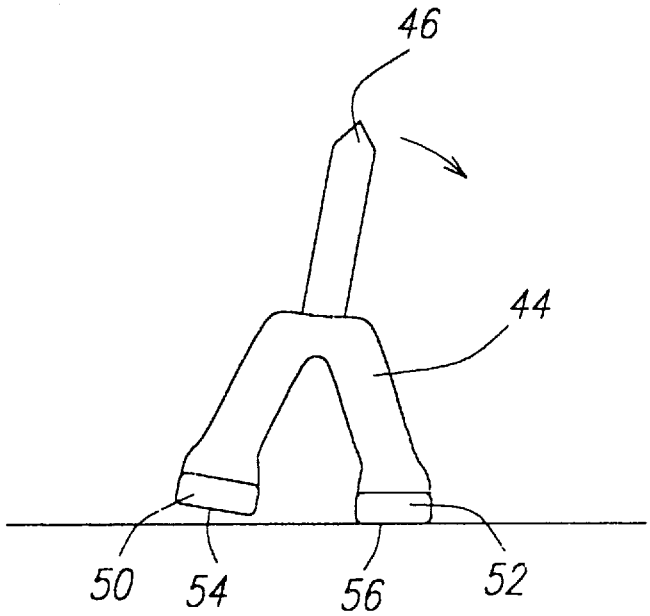
FIG. 4A illustrates the legs portion of the article of FIG. 3 in more detail.
Figure 4B:
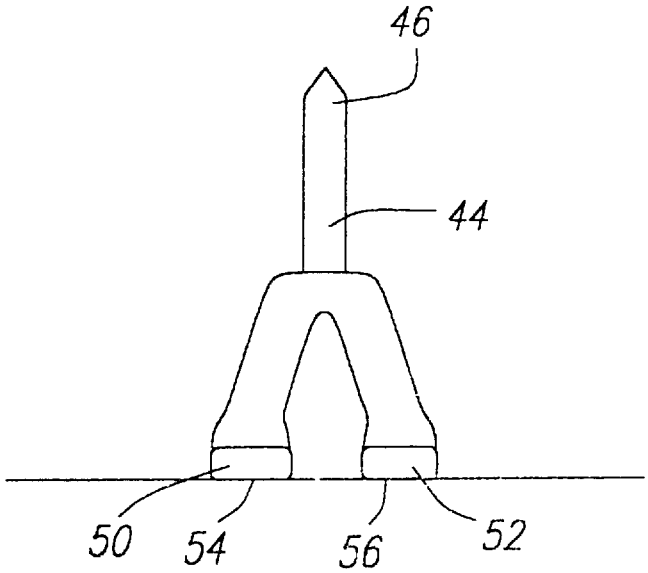
FIG. 4B illustrates an alternative embodiment of the legs portion.

The legs portion 44 includes the pivot point 46 at one end and at the other end of each leg there is provided a magnet 50, 52. The magnets 50, 52 in FIG. 4A are arranged such that the bottom faces 54, 56 respectively are relatively angled such that when one magnet face 56 is in contact with the base as shown in FIG. 4A the bottom face 54 of the other magnet is out of contact and lies at an angle to the base and this increases the visual effect by increasing movement of the article as a whole and of the legs in particular. In FIG. 4B the legs are shown with the magnets 50, 52 in a flat arrangement wherein both contact the surface and this produces a more gentle visual movement effect and thus the appropriate arrangement can be selected to suit the character of the article depicted. In whichever embodiment one of the magnets 50, 52 is provided with a bottom face having a north polarity and the other is provided with a bottom face having a south polarity and this, in conjunction with the rotation of the magnet 26 and the changing degree of influence of the north and south poles caused by this as the control means moves causes the article to have a walking effect as it moves along the base with one leg attracted to contact the base and the other repelled followed by vice versa and so on as the control means magnet rotates and the article moves. Furthermore the ability of the body and head portions to rotate during this movement further mimics the walking effect of a real person.

The separation of the head and body portions from the legs portion also reduces the mass of the article connected to the legs portion which can rotate by freeing the head and body portions to rotate separately and independently and thereby minimises the possibility of the article toppling over as it is caused to move by the influence of the magnet 26.

Figure 5:
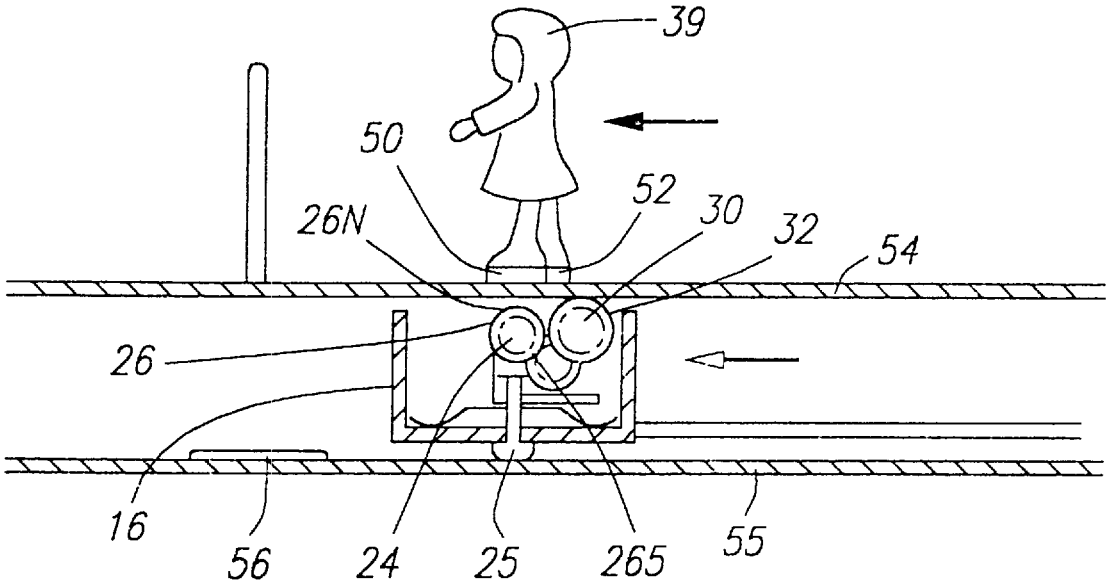
FIG. 5 illustrates the control means and article of the previous Figures in an in use position.

Turning now to FIG. 5 there is illustrated part of the control means with the housing 16 in section and the article 39 in an use position relative to the play base 54 and cover 55 which are shown in section. The article 39 is provided with at least one of the magnets 50,52 in contact with the base 54 and this is achieved by ensuring that the magnetic attraction between the magnets 50, 52 and magnet 26 is sufficiently high to maintain the article 39 in this position. As the control means is moved so the sleeve 32 contacts the underside of the base 54 and rotates the second roller 30 which in turn rotates the roller 24 and magnet 26 mounted in a swash manner thereon. Thus the influence of the north 26N and South 26S poles on the magnet varies in relation to the magnets 50,52 of the article 39 as the magnet rotates serving to attract and repel the magnets as the polarity influence changes. It is believed that the change in influence on the magnets changes in a substantially sinusoidal fashion as the magnet 26 is rotated.

The extent of the visual effect created in mimicking the walking action of the article 39 is dependent to an extent on the angle of the mounting of the magnet 26. In the example shown the magnet is mounted at 30 degrees to vertical and this provides a relatively smooth and relaxed walking effect as the effect that is created is of an increasing in effect of one polarity followed by the other but there is never a single polarity acting on the magnets on the article and thus only a gradual but still visible effect is created as in this case the article depicts a small girl. However if the walking effect was required to be significantly more dramatic, perhaps for example for a boys toy including a model of a robot or the like, then the position of the magnet 26 can be adjusted to create a more dramatic effect by increasing the influence of each pole as the magnet rotates so that at one instant the magnet 26 when adjacent the base 54 has a substantially north polarity and then changes when it rotates to a substantialy south polarity and so on such that the changes of the condition of the magnetic field created during rotation are significantly more marked.

The cover 55 is also shown to have a series of protrusions 56 thereon and these protrusions are located to define the area in which the control means can operate and hence define the area on the upper surface of the base about which the article can be moved. The protrusions define the area in that the pin 25 protruding from the housing 16 contacts the same and stops but the protrusions 56 do not define a particular path of movement of the article and hence the article is free to move in whichever direction selected within the defined area. Typically the protrusions are located in areas which match with particular features of the environment which are created on the upper side of the base 54 such as houses, shops, parks, lakes and the like. Typically the guide pin 25 is bevelled so that a firm tug on the control means can release the housing from any area thereby preventing the article from being stuck.

Figure 6:
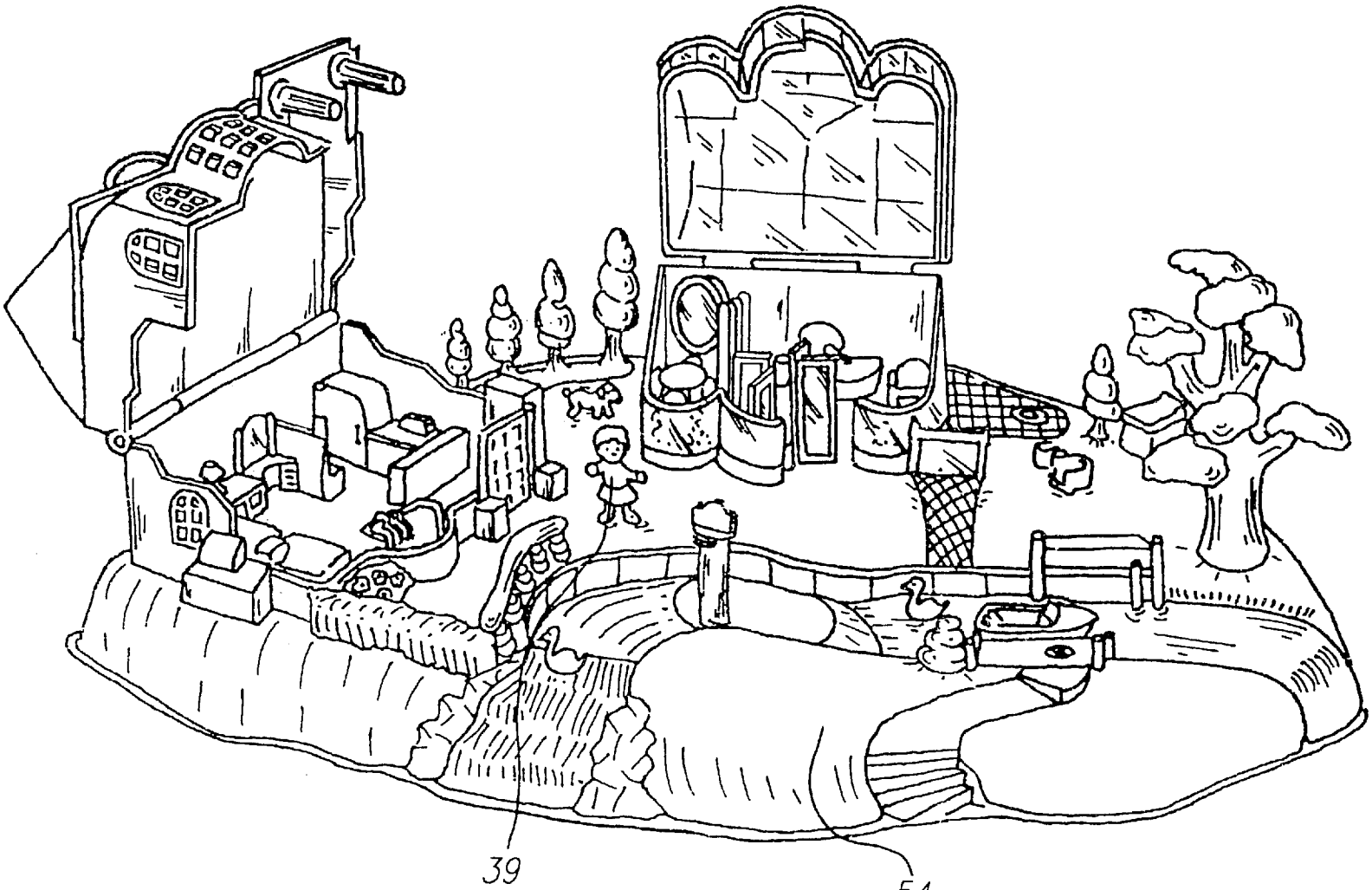
FIG. 6 illustrates the article provided with the base as would be viewed by a child playing with the toy formed according to the invention.

FIG. 6 illustrates the toy in a condition for purchase and use and it is immediately apparent that only the article 39 is visible to the child playing with the toy and thus it appears that the toy is independently movable within the environment. As the article does not have any direct physical control contact it is possible for the article 39 to go through doorways, under arches and actually to move about "inside" the environments and this has a significant effect on the realism and overall attractiveness of the toy formed.

Figure 7:
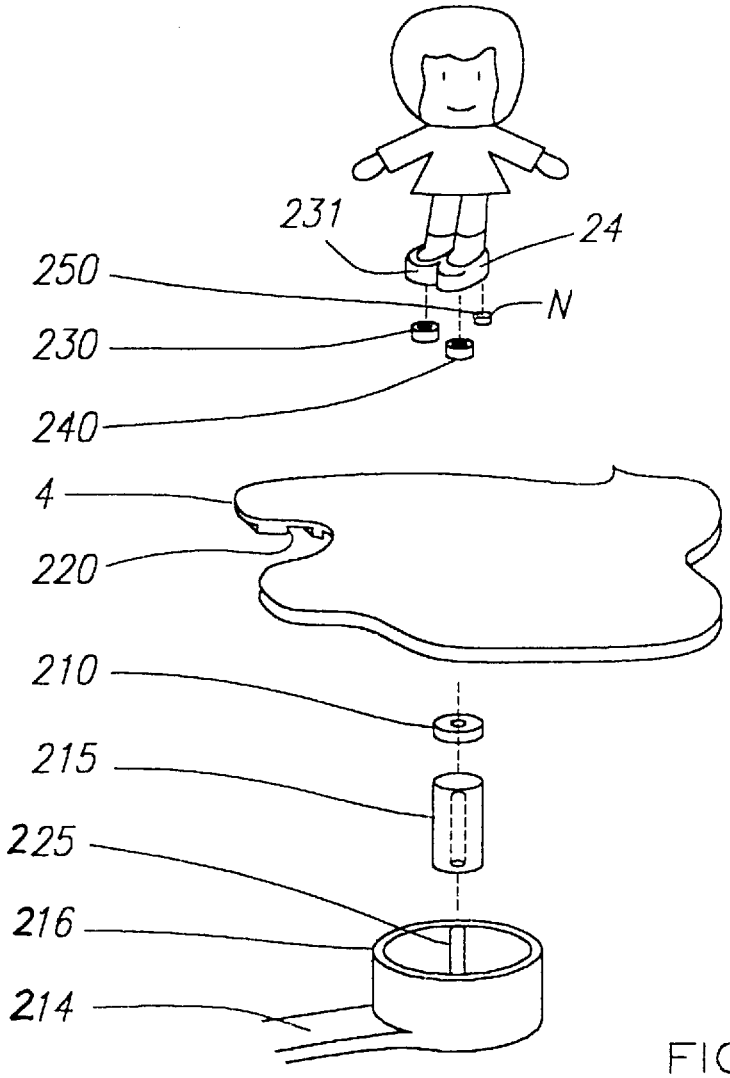
FIG. 7 illustrates a schematic view of the movement assembly detail of the invention and object.
Figures 8, 9:
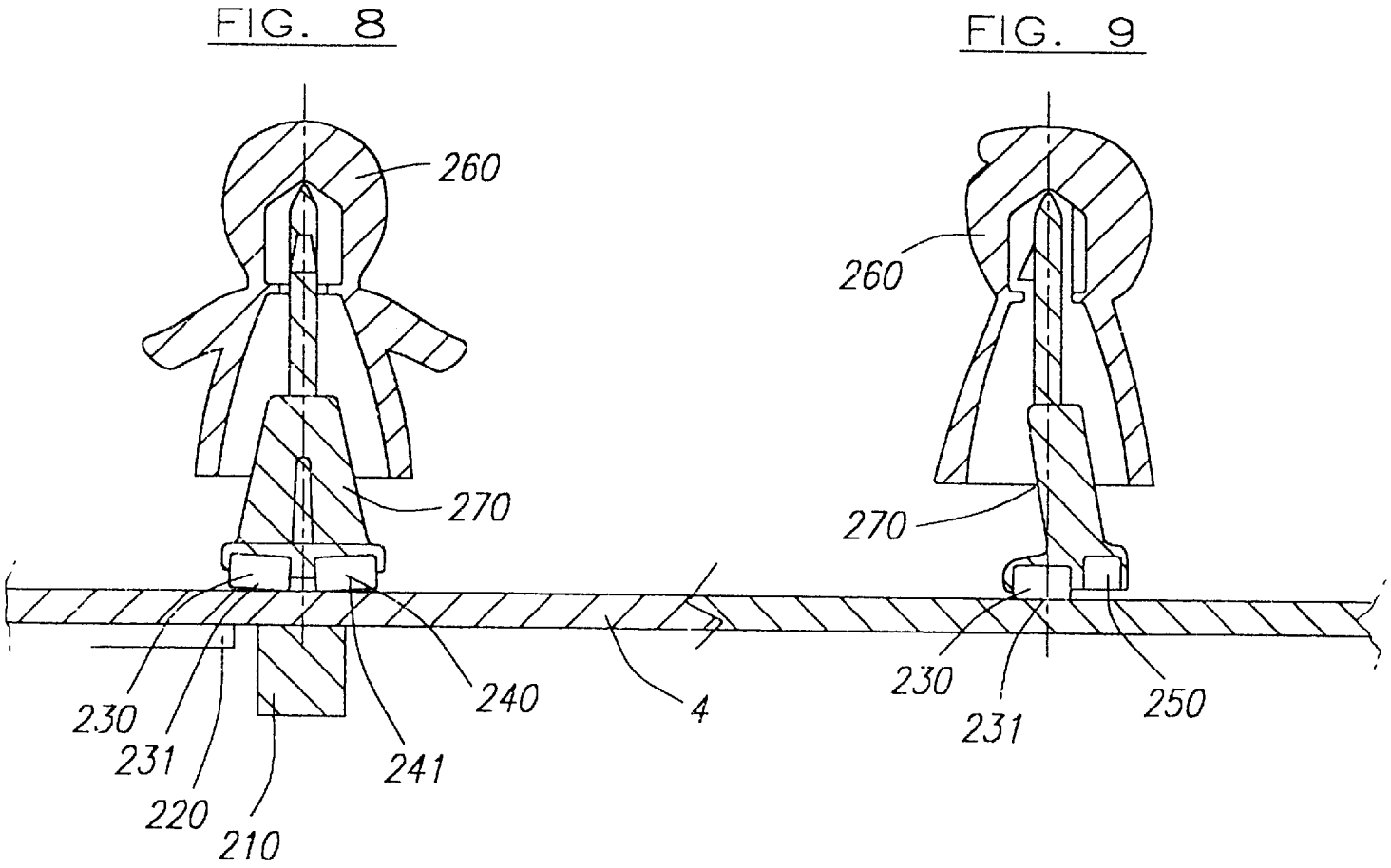
FIG. 8 illustrates a front view of the object, surface and movement assembly in section.
FIG. 9 illustrates a side view of the object, surface and movement assembly in section.

Referring to the FIGS. 7–9, a further movement assembly actuating means is shown which is similar to that previously described with an arm 214 and housing 216. However the arrangement of the interior of the housing is significantly different and comprises a magnet 210 which is fixed to a tube 215 which is slidable along a pin 225 in the housing 216. It should also be appreciated that this is an example of only one possible embodiment.

In use the magnet 210 is laid flat in relation to the playbase 204 and in sliding contact with the underside of the same. The article which in this case is a figure of a girl, is provided on the base, with first and second magnets 230, 240 each mounted at or adjacent the surface of the base 231, 241 of the figure. The undersides 231, 241 and/or magnets are arranged with their outer surface angularly displaced relative to the surface 204 with which they contact as shown in FIG. 8. A third magnet 250 is also provided to the rear of the first and second magnets and this acts to stabilise the object in movement in a manner as is herein described.

In use, the magnet 210 is attracted to the magnets 230, 240, and repelled by the smaller strength magnet 250 of the figure when the assembly and article are in proximity on either side of the surface 204 as shown. As the magnet 210 is attracted it rises up the pin 225 toward the playbase and can engage with the edges of any protrusions 220 formed on the underside of the playbase 204. This allows interaction of the movement of the article in relation to features on the top of the surface 204 the position of which are linked to the position of the protrusions on the underside. When the figure is removed from or misplaced from the playbase so the magnet 210 is no longer attracted and therefore retracts and the movement assembly is then freely movable about the underside of the playbase without contacting any of the protrusions 220 and thus the movement assembly can be moved to "pick up" the article in a particular area of the playbase and then cause the same to move. This is found to increase the effect of the article being independently movable with no visible control acting thereon.

In movement, the first and second magnets, 230, 240 ate provided with the same polarity facing the playbase and the surfaces 231, 241 are angled relative to the playbase 204 in front view. The magnet 210 of the movement assembly is arranged with the opposite polarity facing the underside of the surface and so as it is moved the magnetic attraction between the magnets on either side of the playbase 204 causes the article to be dragged in the direction of movement of the magnet 210. The friction caused when the article is moved from rest, the effect of which is increased by the magnetic attraction loading, prevents a sliding movement of the article until the magnet 210 is a distance in front of the article. At the same time one of the magnets, 230 or 240, for example 230, is attracted towards the magnet 210 and is in contact with the playbase while the other magnet 240 is forced into the air due to the angling of the surfaces 231, 241 as shown in FIG. 8. Further movement of magnet 210 causes the magnet 240 to move more freely towards the magnet 210 than magnet 230 as no friction acts thereon and as it does so it pivots around the position of the magnet 230. As the movement continues so the magnet 240 becomes closer to the magnet 210 than magnet 230 whereupon the increased attraction causes the figure to fall or "topple" and change from contact with the playbase via the base 231 and/or magnet 230 to contact via the magnet 240 and/or base 241 which in turn raises the magnet 230 in the air and thus mimics a "step" taken by a real person which the object, in this embodiment, is provided to imitate. This process repeats between respective magnets 230, 240 and so the walking effect is created.

To prevent the article pivoting backwardly due to the attraction forces created the third magnet 250 is provided with a similar polarity facing the surface to that of the magnet 210 thereby repelling the same and as the magnet 250 is located to the rear of the first and second magnets 230, 240, backwards movement is prevented.

To further increase the visual effect created the body portion 260 can be separate to the legs and bases portion 270 in which the magnets 230, 240, 250 are mounted and said body portion and base portion pivotally movable as illustrated in FIGS. 8 and 9.

What is claimed is:

1. A toy comprising a play base having a top side and a bottom side, an article having a first magnet provided with a first polarity for movement along the top side and a control means mounted underneath the bottom side and having a second magnet provided to create an attractive force between the control means and the article and cause the article to move along the play base in a selected direction following the control means, and wherein the article further includes a weaker third magnet mounted adjacent to the first magnet having a polarity substantially reverse to said first polarity on the first magnet and therefore repelled from the second magnet in the control means.

2. Apparatus according to claim 1 wherein the selected direction of movement of the article along the base is caused by selected movement of the control means.

3. Apparatus according to claim 1 wherein the control means is provided in a form to provide mechanical advantage to the article movement.

4. The toy according to claim 1 wherein said second magnet in the control means is mounted in a housing and the play base further includes a drive arrangement having a lever and an arm disposed between the housing and the lever wherein the drive arrangement is positioned to allow movement of the control means from a point above or to the side of the play base.

5. The toy according to claim 1 wherein the control means is enclosed between the underside of the play base and a cover and wherein the cover or underside of the play base or both includes raised protrusions which act as guide means and define an area of movement of the control means and hence the article on the play base.

6. The toy according to claim 5 wherein the control means further includes a pin arranged to contact with the protrusions and thereby guide the control means.

7. The toy according to claim 1 wherein the article is a human character or animal having at least two feet and wherein at least one first magnet is mounted to each of the at least two feet.

8. The toy according to claim 1 wherein the article is provided with at least two separate leg portions each leg portion having a first end defining a base and wherein the first and third magnets are fixedly attached to each base.

9. The toy according to claim 8 wherein the leg portions further include a second end distal from said first end wherein the leg portions are rigidly interconnected at the second end and wherein each base of the at least two separate leg portions is in the same plane on the play base.

10. The toy according to claim 8 wherein each base of the at least two separate leg portions are arranged such that when one base is in contact with the top side of the play base, at least a portion of the base of the other leg portion lies out of contact and at an angle to the top side of the play base and whereby movement of the article by the control means causes at least a portion of the base of each leg portion to alternatively separate and contact with the top side of the play base.

11. The toy according to claim 8 wherein the at least two separate leg portions have a second end distal from the first end and wherein a body or a head portion or both are pivotally mounted on the second end of the at least two leg portions so the body or head portion or both move relative to the base when the article moves.

12. The toy according to claim 8 wherein the control means includes a housing for mounting the second magnet therein having a designated pole facing towards the underside of said play base.

13. The toy according to claim 12 wherein the housing is mounted to be movable between a first position in contact with the underside of the play base and a second position withdrawn from contact with the underside of the play base.

14. The toy according to claim 12 wherein the second magnet in the control means is arranged to be drawn to the first position by attraction to the first magnet on the article on the upper side of the play base thereby allowing the movement assembly to influence the movement of the article thereafter.

15. A toy according to claim 8 wherein the article includes two first magnets each provided with the same first polarity and attracted to the second magnet in the control means and a third magnet arranged to the rear of the said two first magnets relative to the direction of movement of the article and wherein the third magnet has a polarity reverse to the first polarity and is repelled from the second magnet in the control means.

16. The toy according to claim 15 wherein the underside of the base of the article is angled and portions of said base arranged to lie at substantially equal but opposing angles relative to the play base.

17. The toy according to claim 8 wherein the article comprises at least one base part and an upper part pivotally mounted to the base part to allow relative pivotal movement between said parts and thereby provide axial articulation of the same.

18. The toy according to claim 17 wherein the article further comprises stops to prevent full rotation of the upper part relative to the base part and in part a reverse rotational action on the upper part relative to the base part when the stops are contacted.

19. The toy according to claim 18, wherein the at least two leg portions define legs and feet and the upper part defines the arms, head and torso of the article.

* * * * *